United States Patent [19]

Takayama et al.

[11] Patent Number: 4,637,843

[45] **Date of Patent: * Jan. 20, 1987**

[54] CORE OF A NOISE FILTER COMPRISED OF AN AMORPHOUS ALLOY

[75] Inventors: Suguru Takayama, Tokyo; Masao Shigeta, Urayasu, both of Japan

[73] Assignee: TDK Corporation, Tokyo, Japan

[ * ] Notice: The portion of the term of this patent subsequent to May 6, 2003 has been disclaimed.

[21] Appl. No.: 730,140

[22] Filed: May 3, 1985

Related U.S. Application Data

[63] Continuation-in-part of Ser. No. 592,308, Mar. 22, 1984, abandoned, which is a continuation-in-part of Ser. No. 492,243, May 6, 1983, abandoned.

[30] Foreign Application Priority Data

May 6, 1982 [JP] Japan ..... 57-75915
Nov. 5, 1983 [JP] Japan ..... 58-206898
Oct. 1, 1984 [JP] Japan ..... 59-204141

[51] Int. Cl.[4] ..... H01F 17/06

[52] U.S. Cl. ..... 420/73; 336/180; 148/403; 420/74; 420/75; 420/76; 420/89; 420/94; 420/104; 420/117; 420/118

[58] Field of Search ..... 148/31.55; 75/123 B, 75/123 L, 123 N, 123 K; 148/31.57, 403; 336/180, 181, DIG. 3

[56] References Cited

U.S. PATENT DOCUMENTS 3,683,271 8/1972 Kobayashi ..... 323/76
4,298,409 11/1981 DeCristofaro ..... 148/108
4,437,907 3/1984 Sato et al. ..... 148/31.55

FOREIGN PATENT DOCUMENTS 2924280 1/1981 Fed. Rep. of Germany .
72435 6/1978 Japan .

*Primary Examiner*—Christopher W. Brody
*Attorney, Agent, or Firm*—Armstrong, Nikaido, Marmelstein & Kubovcik

[57] ABSTRACT

The present invention relates to the core of a noise filter.

Conventionally, ferrite or iron powder is used as the core of a noise filter. Some patent publications disclose the core of a noise filter made of an amorphous magnetic alloy.

An amorphous magnetic alloy which as a low pulse-noise resistance deterioration percentage is that on or within the curve X and Y of FIG. 3.

24 Claims, 10 Drawing Figures

CORE OF A NOISE FILTER COMPRISED OF AN AMORPHOUS ALLOY

This is a continuation-in-part application of U.S. patent application Ser. No. 592,308 filed Mar. 22, 1984, now abandoned, which is a continuation-in-part application of U.S. patent application Ser. No. 492,243, filed May 6, 1983, now abandoned.

The present invention relates to the core of a noise filter comprised of amorphous alloy. More particularly, it relates to the core of a noise filter for eliminating pulse noise, the noise filter comprising a core and a pair of windings for generating magnetic fluxes which offset each other.

DESCRIPTION OF THE PRIOR ART

(1) Soft Magnetic Materials

Conventionally, ferrite is used as the core of a noise filter. Ferrite has an excellent permeability characteristic but its saturation flux density is low. Silicon steel are also conventionally used as the core of a noise filter. Silicon steel have a high permeability at a low frequency and a high magnetic flux density. However, the frequency characteristic of the permeability is not excellent. In addition, compacted iron powder is conventionally used as the core of a noise filter. Compacted iron powder has a high saturation density but its permeability is low.

Amorphous alloys can be excellent magnetic materials because of their disordered structure and a watt loss as low as one third that of conventional crystalline alloys. Therefore, as is well known, enormous efforts have been made to investigate the thermally stable soft magnetic properties, such as a high residual flux density, a high saturation flux density, and a low watt loss of amorphous alloy compositions. Such soft magnetic properties can usually be attained when the BH curve has a rectangular shape and is longitudinally elongated, i.e., when the coercive force is low the magnetization at a predetermined magnetic field is high.

Japanese Unexamined Patent Publication No. 54-148122 discloses an amorphous alloy which contains from 80 to 84 atomic % of iron, from 12 to 15 atomic % of boron, and from 1 to 8 atomic % of silicon and which exhibits a high saturation flux density, a high ductility, and a high-tempertaure stability.

U.S. Pat. No. 4,217,315 illustrates the composition of an Fe-B-Si based amorphous alloy by a curved area and describes an $Fe_{81}B_{13.3\text{-}15.7}Si_{3\text{-}5}$ composition as a typical one which has a high saturation magnetization, a high crystallization temperature, and a low coercive force and is thus excellent for use as a motor and a transformer.

U.S. Pat. No. 4,219,355 discloses that in an $Fe_aB_b$-$Si_cC_d$-based amorphous alloy the composition a=80-.0-82.0 atomic %, b=12.5-14.5 atomic %, c=2.5-5.0 atomic %, and d=1.5-2.5 atomic % is superior in coercive force, magnetic flux density, and watt loss at a commercial frequency.

Japanese Unexamined Patent Publication No. 57-116750 discloses that, in an $Fe_aSi_bB_c$-based amorphous alloy, the composition a=75-78.5 atomic %, b=4-10.5 atomic %, and c=11-21 atomic % has excellent alternating-current excitation characteristics, i.e., a low power loss and a low exciting force. In this publication, it is specifically disclosed that the magnetic properties are improved by carrying out a heat treatment under a magnetic field.

Japanese Unexamined Patent Publication No. 57-137451 discloses that an amorphous alloy which consists of from 77 to 80 atomic % of iron, from 12 to 16 atomic % of boron, and from 5 to 10 atomic % of silicon exhibits the following properties: 15 kG or more of a saturation magnetization, approximately 0.04 Oe or less of a coercive force, and 0.1 W/pound of watt loss (12.6 kG, 60 Hz).

Japanese Unexamined Patent Publication No. 58-34162 discloses that an amorphous alloy which consists of from 78 to 82 atomic % of iron, from 8 to 14 atomic % of boron, from 5 to 15 atomic % of silicon, and up to 1.5 atomic % of carbon has an anti-magnetic aging property and good watt loss and magnetic flux density.

Japanese Unexamined Patent Publication No. 58-42751 discloses that in an amorphous alloy which consists of from 77 to 79 atomic % of iron, from 8 to 12 atomic % of silicon, from 9 to 11 atomic % of boron, and from 1 to 3 atomic % of carbon, the secular change of magnetic properties is very small.

Japanese Unexamined Patent Publication No. 56-127749 discloses than when x is from 4 to 9.5 atomic % and a is from 82 to 86 atomic % in an $Fe_{a-x}B_{10-0-a-x}Si_{2x}$ composition, the amorphous alloy has thermally stable soft magnetic properties.

Japanese Unexamined Patent Publication No. 57-190304 discloses that in the $Fe_{100-a-b-c}Mo_aX_bY_c$ composition (X is Ni, Co or the like, Y is Si, Al, B, C or the like, a is from 0.1 to 6 atomic %, b is from 0 to 30 atomic %, and c is from 15 to 30 atomic %), Mo is effective for enhancing the squareness ratio, i.e., providing the amorphous alloy with a squareness ratio of 60% or more under a direct current magnetization.

In the above-described prior art, most of the investigations are directed to finding the appropriate content at around approximately 80 atomic %. In these prior arts, no composition which can exhibit excellent properties as the core of a noise filter can be found except for Japanese Unexamined Patent Publication No. 57-116750, in which appropriate B and Si contents at an Fe content of 75 atomic % are investigated, and except for Japanese Unexamined Patent Publication No. 57-190304, in which the enhancement of the squareness ratio due to Mo is reported. However, since in Japanese Unexamined Patent Publication No. 57-116750 the amorphous alloy is subjected to a heat treatment under a magnetic field so as to provide a square and longitudinally long BH curve, properties suitable for a core of a noise filter cannot be obtained.

Proc. 4th Int. Conf. on Rapidly Quenched Metals (Sendai, 1981) pp 1035-1038 reports a study of the permeability change depending upon the frequency regarding the $(Fe_{0.76}B_{0.14}Si_{0.10})_{98}(Be, C, Al, Co, Ni, Cr, Nb)_2$ and $(Fe_{1-x}Co_x)_{74}Cr_2B_{14}Si_{10}$ compositions. Disclosed in this study is an abnormal phenomenon in which the permeability drastically decreases at a certain frequency, e.g., in this vicinity of 50 kHz, by approximately 20 percent. The report also discloses that this abnormal decrease in the permeability is attributable to a magnetomechanical resonance, and is mainly influenced by the magnetostriction; that is, the abnormal decrease in the permeability is most remarkable in amorphous alloys having a large magnetostriction.

(2) Noise Filter

The noise filter may be referred to as a two-line power filter for digital equipment, such as in U.S. Pat. No. 3,996,537, or a power supply filter for noise suppression, such as in U.S. Pat. No. 3,683,271.

The prior art of a noise filter is described with reference to FIG. 1.

Figure 8:
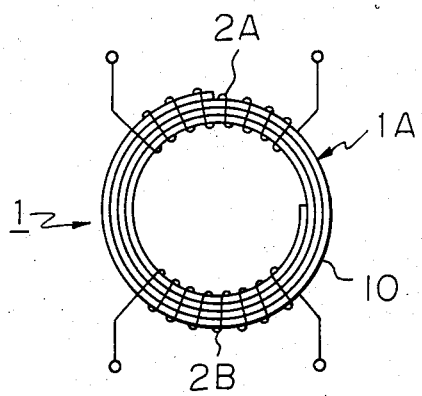
Fig. 8 PRIOR ART
Figure 9:
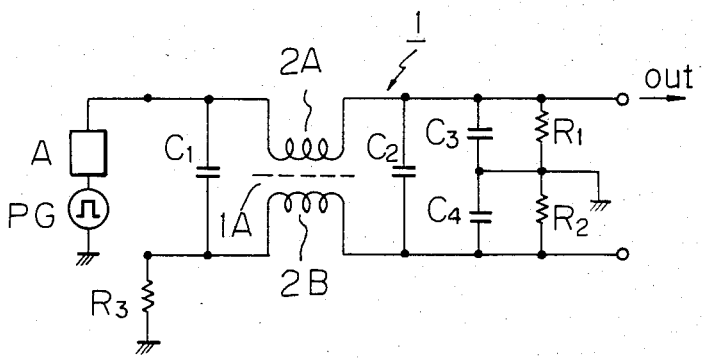
Fig. 9 PRIOR ART
Figure 10:
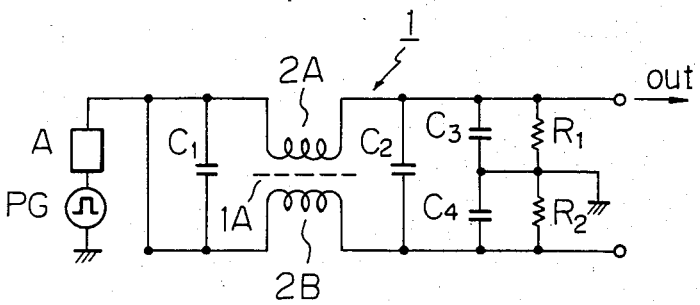
Fig. 10 PRIOR ART

FIG. 8 schematically illustrates the core and windings of the noise filter according to the prior art;

FIG. 9 is an electric circuit used for testing the core of a noise filter; and FIG. 10 is a drawing similar to FIG. 9.

Figure 1:
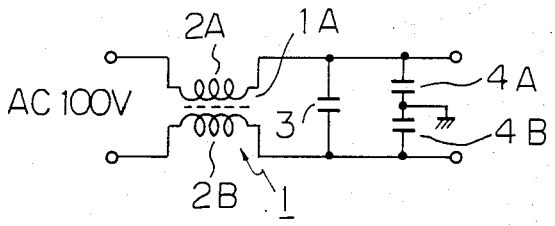
Fig. 1 PRIOR ART
FIG. 1 is a circuit of a noise filter.

Referring to FIG. 1, the noise filter 1 comprises the core 1A and a pair of windings 2A and 2B. The alternating current indicated by AC 100 V is applied to the noise filter and generates magnetic fluxes when conducted through the windings 2A and 2B. The sum of the magnetic fluxes produced by the windings 2A and 2B is zero.

Figure 2:
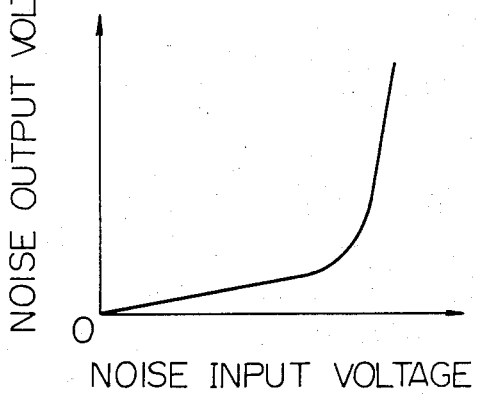
FIG. 2 is a graph illustrating the relationship between the noise input voltage and the noise output voltage.

A capacitor 3 and capacitors 4A and 4B are connected between the windings 2A and 2B. The capacitors 4A and 4B are connected to each other and are grounded at the connecting point thereof. The relationship between the noise input voltage and the noise output voltage is shown in FIG. 2. As is apparent from FIG. 2, the noise output voltage abruptly increases when the noise input voltage exceeds a critical value. This is because the core 1A (FIG. 1) of the noise filter is magnetically saturated, and when such an abrupt increase in the noise output voltage occurs, the noise filter does not function. The curve shown in FIG. 2 has in the low-noise output range an inclination which is determined by the inductance of the noise filter 1 (FIG. 1), i.e., the permeability of the core 1A. The inclination is lessened in accordance with an increase in permeability. The noise input voltage, at which the curve shown in FIG. 2 abruptly increases, is determined by the saturation flux density of the core 1A. Therefore, the core of a noise filter must have a high permeability and a high saturation flux density. In addition, when a noise filter is used for filtering noise of a high frequency voltage, the frequency characteristic of the permeability must be excellent.

Japanese Unexamined Patent Publication No. 56-46516 discloses a core of a noise filter which consists of an essentially completely amorphous alloy. This core is remarkably improved over the conventional ones, especially when it is used for filtering a high noise voltage. However, it is insufficient for suppressing a high-voltage noise pulse of 1,000 V or more generated for 1 μsec or more. Such a noise pulse is frequently superimposed on the current of a power line or power circuit.

Japanese Unexamined Patent Publication No. 57-24519 discloses a core of a noise filter which consists of a magnetic amorphous alloy which partially contains precipitated crystals. The core was invented by the present inventors, who discovered that when precipitated crystals are present in an amorphous alloy the core can effectively suppress a high-voltage noise pulse.

Japanese Unexamined Patent Publication No. 57-24158 specifies the BH curve of an amorphous alloy for use as a noise filter. In more detail, as is noted hereinabove with reference to FIGS. 1 and 2, a high inductance or a high permeability of the core of a noise filter usually results in a decrease in the noise output voltage. However, in the case of a square and longitudinally long BH curve which is obtained by increasing the permeability, a high-voltage noise pulse cannot be eliminated. Therefore, in this publication the BH curve is specified to have a slanted shape in terms of 2,000 $G \leqq B_2 \leqq 0.7$ Bs(G), wherein $B_2$ is the magnetic flux density at a magnetization of 2 Oe and 50 kHz and Bs is the saturation flux density. In this publication, $Fe_{76}CO_4B_{18.9}Si_{2.1}$, $Fe_{78.4}Ni_{1.6}B_{12}Si_8$, $Fe_{62.4}Ni_{16}Mo_{1.6}B_{16}Si_4$, and the like are mentioned as amorphous alloys.

Japanese Patent Application No. 56-185201 discloses that an amorphous alloy which has a specified BH curve in terms of μi (initial permeability)=2,000–5,000, $Br \leqq 3{,}000$, $B_2$=6–9 kG, and $B_s \geqq 12$ kG can eliminate a high-voltage noise pulse when used as a noise filter.

Preferable magnetic properties of the core of a noise filter are different from those of a core of a conventional transformer, an electric motor, or the like in the following respects. In the core of a noise filter, the BH curve should be slanted, i.e., a constant permeability characteristic or an unchanged permeability μ, depending upon the magnetic field, and a not very high residual flux density Br. Such a BH curve is undersirable for the core of a transformer, an electric motor, or the like.

Presumably, the properties required for the noise filter can be obtained by adjusting the composition of the amorphous alloy to have zero magnetostriction, since the above described abnormal decrease in the permeability, which is undesirable for the core of a noise filter, can be avoided by the zero-magnetostrictive composition, according to the report Proc. . . . Rapid Quench Metal. In the Co-based amorphous alloy having zero magnetostriction, the properties other than the magnetostriction especially the magnetic flux density, are poor, and further, the magnetic properties exhibit a great secular change. This makes the zero magnetostrictive alloy inappropriate for the core of a noise filter.

SUMMARY OF THE INVENTION

It is an object of the present invention to provide a core of a noise filter which consists of a novel amorphous alloy and has characteristics superior to those of the known amorphous alloy cores.

It is another object of the present invention to improve the durability of the core of a noise filter so that its filter characteristics do not deteriorate during long-term use.

It is yet another object of the present invention to provide an amorphous alloy which can prevent deterioration of the properties of the core of a noise filter, which deterioration may occur in a known noise-filter core composed of, for example, approximately 80% of Fe and, occasionally, Co or Ni, the balance being B and/or Si.

It is a further object of the present invention to provide an amorphous alloy which can prevent pulse-resistance deterioration of the core of a noise filter.

Pulse-resistance deterioration, discovered by the present inventors, is a phenomenon in which a high-voltage noise pulse can be eliminated as desired the first time a noise filter is used but cannot be eliminated at subsequent times the noise filter is used.

The core of the noise filter according to the present invention comprises a coiled thin strip of an amorphous magnetic alloy which partially contains precipitated crystals and essentially has the following composition:

$$M_xMn_y(Si_tB_qC_l)_z,$$

wherein M is Fe or Fe together with at least one transition metal element other than Fe, $x+y+z=100$ atomic %, y is from 0.1 atomic % to 10 atomic %, z is from 16 atomic % to 32 atomic %, $t+q+l=1$, t is from 0.20 to 0.80, l is from 0.0001 to 0.05, the ratio l/q is from 0.01 to 0.4, and $20t+6 \leqq z \leqq -50t+67$. This composition is hereinafter referred to as the first composition.

The core of the noise filter according to the present invention comprises a coiled thin strip of an amorphous magnetic alloy which partially contains precipitated crystals and which essentially has the following composition:

$$M_xMn_y(Si_tB_qC_lP_s)_z,$$

wherein M is Fe or Fe together with at least one transition metal element, y is from 0.1 atomic % to 10 atomic %, z is from 16 atomic % to 32 atomic %, $t+q+l+s=1$, t is from 0.20 to 0.80, s is from 0.0001 to 0.05, the ratio l/q is from 0.01 to 0.4, and $20t+6 \leqq z \leqq -50t+67$. This composition is hereinafter referred to as the second composition.

Figure 3:
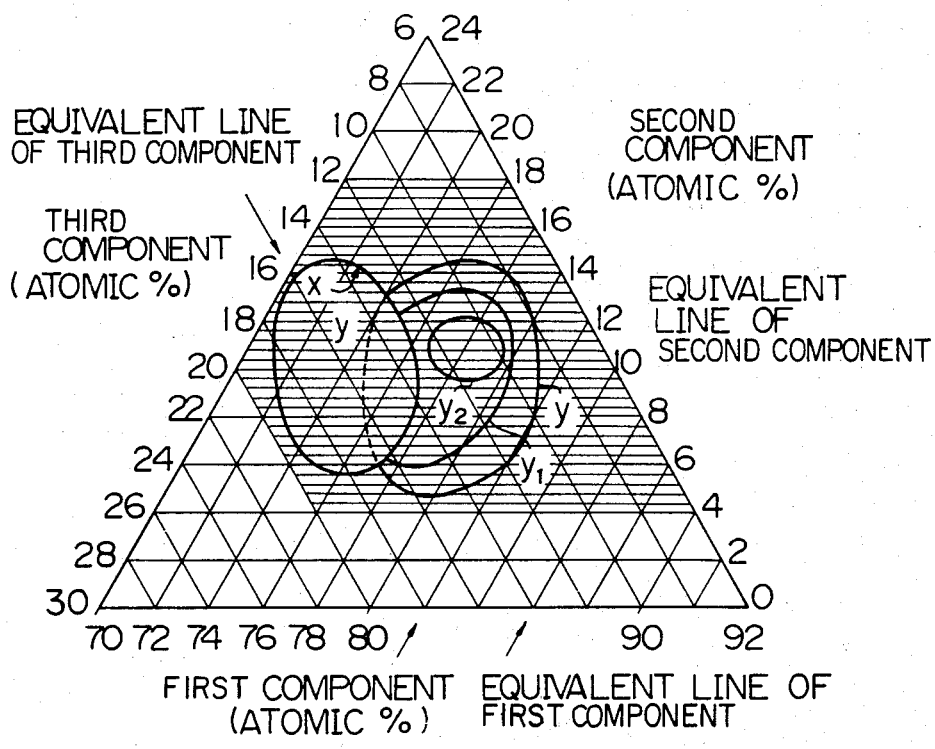
FIG. 3 is a diagram showing the range of first, second, and third components according to the present invention.

The core of a noise filter according to the present invention comprises a coiled thin strip of an amorphous magnetic alloy which essentially consists of a first component which is Fe or Fe together with at lease one transition metal element, a second component which is at least one selected from the group consisting of Si and Al, and a third component which is at least one selected from the group consisting of B, C, and Al, the first, second, and third components being contained in an amount falling on or within curve X shown in FIG. 3, and exhibits a permeability ($\mu_2$) of from approximately 2,000 to approximately 5,000, i.e., a permeability measured at 100 kHz and a magnetic field of 2 mOe, a 3 kG or less of a residual flux density (Br) determined on a BH curve at a frequency of 2 kHz and a maximum applied a magnetic field of 2 Oe, and from 6 kG to 9 kG of a magnetic flux density ($B_2$), i.e., a magnetic flux density at 2 Oe. The composition of this amorphous magnetic alloy is hereinafter referred to as the third composition. An amorphous magnetic alloy having the third composition has a low pulse-resistance deterioration.

The core of a noise filter according to the present invention comprises a coiled thin strip of an amorphous magnetic alloy which essentially consists of a first component which is Fe or Fe together with at least one transition metal element, a second component which is at least one selected from the group consisting of Si and Al, and a third component which is at least one selected from the group consisting of B, C, and Al, the first, second and third components being contained in an amount falling on or within curve Y and falling outside the curve X shown in FIG. 3, and exhibits a permeability ($\mu_2$) of approximately 4,000 or more, i.e., a permeability measured at 100 kHz and a magnetic field of 2 mOe, a 3 kG or less of a residual flux density (Br) determined on a BH curve at a frequency of 2 kHz and a maximum applied a magnetic field of 2 Oe, and from 5 kG to 11 kG of a magnetic flux density ($B_2$), i.e., a magnetic flux density at 2 Oe. The composition of this amorphous magnetic alloy is hereinafter referred to as the fourth composition. An amorphous magnetic alloy having the fourth composition has a low pulse-resistance deterioration and a high permeability.

DESCRIPTION OF THE PREFERRED EMBODIMENTS

First and Second Compositions

Alloy Components

The first and second compositions of the thin strip of an amorphous magnetic alloy are now explained.

The at least one transition metal element, which is hereinafter referred to as M, is selected from the 4s-transition elements (Sc-Zn), the 5s-transition elements (Y-Cd), the 6s-transition elements (La-Hg), and elements having atomic numbers equal to or greater than Ac. M may be Co, Ni, Cr, Cu, Mo, Nb, Ti, W, V, Zr, Ta, Y, or a rare earth element.

Mn is an essential element of the first and second compositions. If the content of Mn is less than 0.1 atomic %, the secular change of the inductance and permeability is great when the amorphous magnetic alloy is used as the core of a noise filter for a long period of time. In addition, if the content of Mn is less than 0.1 atomic %, the time and temperature conditions of the heat treatment are very limited when crystals are to be precipitated in the amorphous magnetic alloy, with the result that the precipitation of fine crystals in a desired manner becomes difficult. When y is more than 10 atomic %, the formation of a this strip becomes difficult and the saturation magnetization is small, with the result that the suppression of a high-voltage noise pulse is decreased. It is preferred that y be in the range of from 0.1 to 5 atomic %.

Z is the total content of the metalloid elements, i.e., Si, B, and C in the first composition and Si, B, C, and P in the second composition.

When z is less than 16 atomic % or more than 32 atomic %, the formation of a thin strip of an amorphous alloy becomes difficult, and it also becomes difficult to form precipitated fine crystals by means of a heat treatment. When z is less than 16 atomic %, the crystallization temperature is disadvantageously lowered. When z is more than 32 atomic %, the saturation flux density is disadvantageously lowered.

T is the content of Si based on the metalloid elements. When t is less than 0.20, the secular change of the inductance and permeability is too great to obtain a core of a noise filter having a stable characteristic. When t is more than 0.80, the formation of a thin strip becomes difficult, and the carrying out of a heat treatment for precipitating fine crystals becomes difficult.

Z and t must have the relationship expressed by the formula $20t+6 \leqq z \leqq -50t+67$ so as to facilitate the formation of a thin strip and the heat treatment for precipitating fine crystals.

Figure 4:
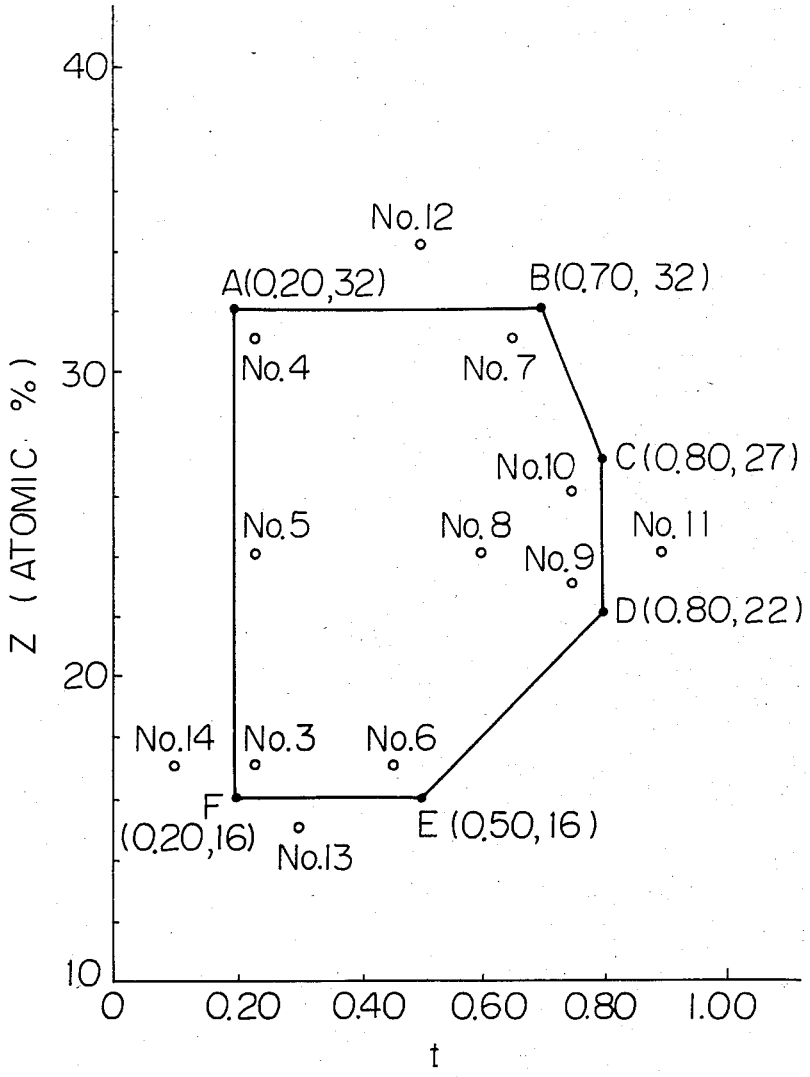
FIG. 4 is a graph illustrating the values of t and z of Sample Nos. 1 through 12 and the ranges of t and z according to the present invention.

The relationship between t and z is shown in FIG. 4. In FIG. 4, the points A through F indicate the following:

A (t=0.20, z=32)
B (t=0.70, z=32)
C (t=0.80, z=27)
D (t=0.80, z=22)
E (t=0.50, z=16)
F (t=0.20, z=16)

The line DE corresponds to the equation $z=20t+6$, and the line BC corresponds to the equation $-50t+67$. The t and z on and within the lines AB, BC, CD, DE, EF, and FA are those of the present invention.

It is critical in the present invention that the ratio l/q be from 0.01 to 0.4. When the ratio l/q is more than 0.4, it is difficult to form a thin strip and the magnetic properties are impaired.

In the second composition, P (phosphorus) is contained as one of the metalloid elements and contributes to suppression of the secular change of the inductance and permeability, with the result that the durability of the core of the noise filter is enhanced. S, i.e., the content of phosphorus, is from 0.0001 to 0.05, preferably from 0.0001 to 0.02. When s is more than 0.05, the suppression of high-voltage noise pulse is decreased.

In the first and second compositions, one or more of the metalloid elements Al, Be, Ge, Sb, and In may be additionally contained provided that the total amount thereof if up to 10 atomic % based on the total number of metalloid elements.

The core according to the present invention is highly resistant against impact which may be applied to it during handling, for example, due to its dropping.

Structure of Amorphous Alloy

Usually, an amorphous alloy is distinguished from a conventional crystalline alloy in that in X-ray diffraction of the amorphous alloy there is no diffraction of the crystal lattices. The absence of diffraction of the crystal lattices is usually referred to as a halo pattern.

The thin strip of an amorphous magnetic alloy having the first and second compositions according to the present invention is distinguished from a conventional amorphous alloy by the presence of precipitated fine crystals in the amorphous phases.

The diffraction specter of the thin strip of an amorphous magnetic alloy having the first and second compositions of the present invention shows a halo pattern in the amorphous phases and a Debye-Scherrer ring of the precipitated fine crystals. Judging from the diameter and width of the Debye-Scherrer ring, the precipitated crystals are very fine and have an average grain diameter of from 10 to 1,000 Å (from 1 to 100 nm). The X-ray tube voltage and current are usually 30 KV and 100 mA, respectively, in the X-ray diffraction method.

The precipitated fine crystals are different from the crystals in an incomplete amorphous alloy, in which crystals are formed due to incomplete vitrification. The precipitated fine crystals are intentionally formed by means of a heat treatment at a temperature below the crystallization temperature. The heat treatment time depends on the temperature. The precipitated fine crystals are very fine and induce magnetic anisotropy while the crystals formed due to incomplete vitrification are coarse and do not induce magnetic anisotropy. The precipitated fine crystals contribute to improvement of the suppression of a high-voltage noise pulse and to improvement of the thermal stability.

The diffraction specter of an amorphous alloy containing precipitated fine crystals shows a halo pattern which is peculiar to an amorphous alloy and peaks which overlap the halo pattern and demonstrate the presence of crystals. In addition, in the diffraction image of the amorphous alloy containing fine crystals, spots are superimposed on the halo pattern, and a Debye-Scherrer ring(s) having a ring diameter and a width determined by a crystal(s) appear.

The proportion of crystals to glass can be determined by measuring the halo pattern area and peak pattern area of the diffraction specter and then obtaining the ratio of the halo pattern area to the peak pattern area. A preferable ratio of crystals to glass is from 0.1 to 50:100.

Third and Fourth Compositions

Components of Third Composition

The third composition is now described.

The first component is Fe or Fe and at least one transition metal element. The at least one transition metal element is selected from the 4s-transition elements (Sc–Zn), the 5s-transition elements (Y–Cd), the 6s-transition elements (La–Hg), and elements having atomic numbers equal to or greater than Ac and may be Co, Ni, Cr, Cu, Mo, Nb, Ti, W, V, Zr, Ta, Y or a rare earth element.

M is preferably Mn, Cr, Mo, Nb, Ni, or Co, more preferably Mn. When Ni, Co, and Fe are used as M, Ni and Co may be approximately 20% or less based on M. When, in addition to one or more of Ni, Co, and Fe, the other elements are used as M, their amount is usually approximately 5 atomic % or less.

The second component is at least one element selected from the group consisting of Si and Al. The content of Al is preferably 10 atomic % of less based on the total content of Si and Al.

The third component is at least one element selected from the group consisting of B, C, and P. The content of C is preferably 20 atomic % or less based on the total of B, C, and P, and the content of P is preferably 5% or less based on the total of B, C, and P.

In addition to the first, second, and third components, at least one element selected from the group consisting of Be, Ge, Sb, and In may be contained in the third composition since such element does not impede the effects of the present invention.

If the composition of an amorphous alloy is on or within the curve X, the soft magnetic properties are somewhat inferior to those outside the curve X but not only can a high-voltage noise pulse be effectively eliminated but also pulse-resistance deterioration is not appreciable.

When the first, second, and third components are located on or within the four-sided region formed by connecting (73, 9, 18), (73, 12, 15), (76, 9, 15), and (76, 6, 18) expressed by the ternary ordinate in atomic %, pulse-resistance deterioration is very small.

Magnetic Properties of Third Composition

The magnetic properties of the amorphous alloy having the third composition are now described.

If the permeability ($\mu_2$) is less than approximately 2,000, the inductance of the core of a noise filter is low so that the noise output voltage is disadvantageously high. On the other hand, if the permeability ($\mu_2$) is more than approximately 5,000, the BH curve markedly tends to saturate at low pulse voltage, with the result that a high-voltage noise pulse cannot be eliminated. The residual flux density (Br) should be as low as possible. If the residual flux density (Br) is more than 3 kG, the constant permeability characteristic is lost and the compositional range of the amorphous alloy, in which the eliminating ratio of pulse voltage is high, tends to be disadvantageously narrowed.

Pulse-resistance deterioration is not quantitatively determined in the industrial standards of inductors or the like. The VDE 0565 Teil 3.3.6 inductance 3.6.2 of West Germany is an industrial standard which specifies general inductors, and in this standard it is mentioned that when current is supplied to a rod core or a choke coil made of a dust core, the variation in industance from the nominal value must be ±20% or less. This variation can undoubtedly be satisfied according to the third composition.

The pulse-resistance deterioration percentage is defined herein by the equation:

$$\frac{\mu e\left(\begin{array}{l}\text{after application}\\ \text{of a magnetic}\\ \text{field of 4 Oe}\end{array}\right) - \mu e\ (\text{demagnetization})}{\mu e\ (\text{demagnetization})} \times 100(\%),$$

wherein $\mu e$ is the permeability at 100 kHz and 2 mOe (0.002 Oe) and the demagnetization is a demagnetized state of zero magnetic flux density.

Prior to defining the pulse-resistance deterioration percentage, the present inventors manufactured amorphous alloy cores in a toroidal form 31 mm in outer diameter, 19 mm in inner diameter, and 8 mm in height, applied a magnetic field of 20 Oe or less to them, demagnetized them, and measured the following permeability changes:

$$\frac{\mu e\left(\begin{array}{l}\text{after application}\\ \text{of a magnetic}\\ \text{field of}\end{array}\right) - \mu e\ (\text{demagnetization})}{\mu e\ (\text{demagnetization})} \times 100(\%),$$

Figure 5:
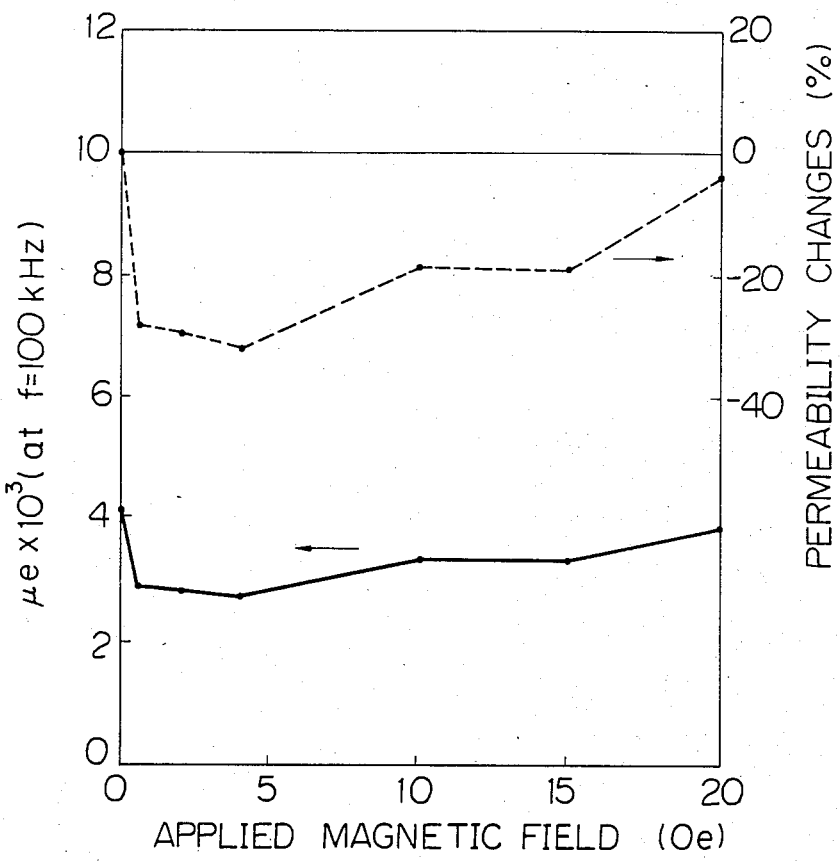
FIG. 5 is a graph illustrating the permeability and permeability changes depending upon the applied magnetic field.

The present inventors obtained the results shown in FIG. 5.

As is apparent from FIG. 5, the reduction in permeability ($\mu e$) is the greatest at 4 Oe of the applied magnetic field. That is, when a magnetic field of 4 Oe is applied to the amorphous alloy cores, the permeability ($\mu e$) is reduced by approximately 30% compared with the permeability ($\mu e$) before application of the magnetic field, i.e., the permeability ($\mu e$) which an amorphous alloy primarily exhibits. This means that a high-voltage noise pulse, which can ordinarily be primarily eliminated, may not be able to be eliminated since the ability to eliminate noise decreases by approximately 30% when an extraneous noise which generates a magnetic field of 4 Oe is applied to a core.

Based on the results obtained by the present inventors, the pulse-resistance deterioration percentage is determined as above. By controlling the pulse-resistance deterioration percentage, it is possible to control the most serious pulse-resistance deterioration which can possibly occur in cores. When the pulse-resistance deterioration percentage is appropriately controlled, pulse-resistance deterioration which may occur at a magnetic field higher than 4 Oe can be controlled. In addition, the permeability ($\mu_2$) represents the noise-pulse suppression characteristics of a core to which a magnetic field higher than 2 mOe is applied due to a noise-pulse voltage.

Previously, there have been no quantitative methods for evaluating deterioration in pulse suppression, presumably because the inherent unforeseeable variation of a noise pulse, i.e., a great noise-pulse voltage variation and plus or minus charge variation, hindered the development of such quantitative methods.

In an embodiment (the third composition) of the present invention, the pulse-resistance deterioration percentage is 10% or less.

In another embodiment, in which the first, second, and third components are appropriately selected within the curve X, the pulse resistance deterioration percentage is 5% or less.

Figure 6:
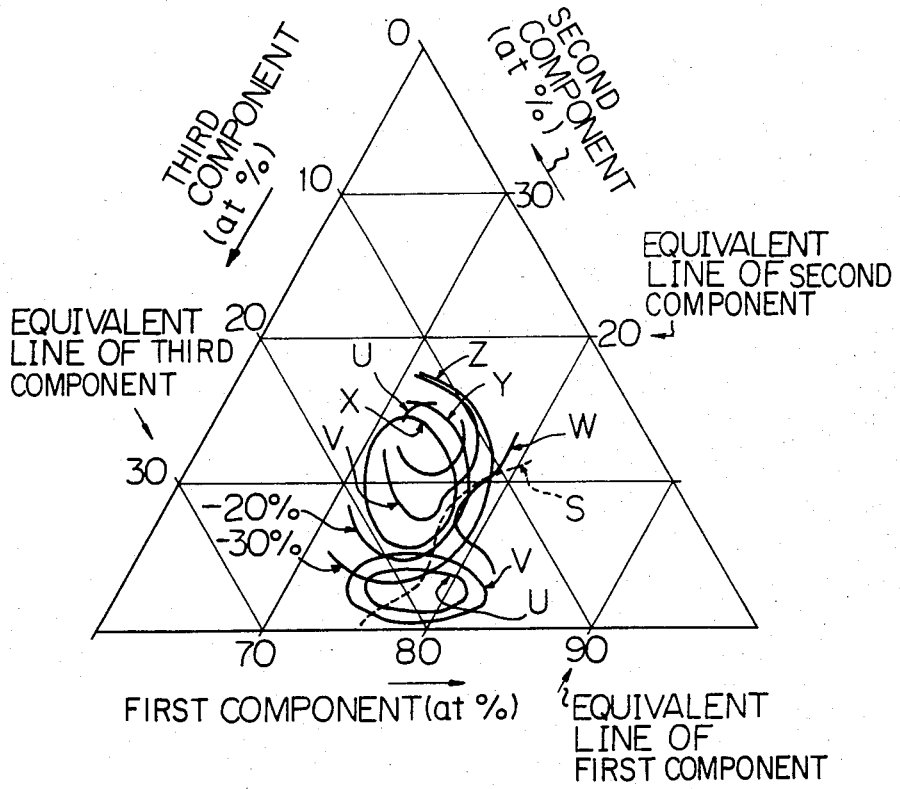
FIG. 6 is a ternary diagram of amorphous alloys.

Referring to FIG. 6, the range of the third composition is denoted by curve X in the ternary diagram. Curves Y and Z indicate compositions having a pulse-resistance deterioration percentage of −20% and −30%, respectively.

If the content of the first component is less than 70 atomic %, vitrification of an alloy which consists of the first, second, and third components becomes difficult.

Curves U, V, and W indicate compositions having, after demagnetization, a permeability of 10,000, 7,500, and 5,000, respectively, measured at 100 kHz. The permeability measured at 25 kHz is the highest within the curve U. The compositional range within the curve U is almost coincident with that where the permeability ($\mu_2$) is the highest.

As will be understood from the descriptions with reference to FIG. 6, the content range of the first, second, and third components where the pulse-resistance deterioration percentage is low is not coincident with that where the permeabilities are the highest.

Curve S in FIG. 6 indicates the amounts of the first, second, and third components, at which amounts the saturation flux density measured at 2 kHz of alternating current and 10 Oe of magnetization force becomes approximately 15 kG. When the amounts of the first, second, and third components are on the right-hand side of the curve S (on the iron-rich side), the above-mentioned saturation flux density becomes high. Therefore, the amounts of the first, second, and third components indicated by the curve X according to the present invention are such that the above-mentioned saturation flux density ($B_s$) is low.

Fourth Composition

The fourth composition is now explained.

Effects of Mo

The fourth composition, in which Fe of the third composition is partly replaced with Mo, attains a pulse-resistance deterioration equivalent or superior to that of the third composition, where the contents of first, second, and third components are outside the curve X shown in FIG. 3.

An effect of Mo discovered by the present inventors is described with reference to Table 1.

TABLE 1

| Properties | Amount of Mo x (at %) 0 | 3 | 6 |
|---|---|---|---|
| $\mu_2$ (after demagnetization) | 5,000 | 7,100 | 6,100 |
| $\mu_2$ (after pulse-deterioration) | 4,000 | 5,700 | 5,700 |
| Pulse resistance deteriora- | 20 | 20 | 7 |

TABLE 1-continued

| Properties | Amount of Mo x (at %) 0 | 3 | 6 |
|---|---|---|---|
| tion percentage (%) | | | |

Table 1 shows the properties of the amorphous alloy having an $Fe_{76-x}Mo_xSi_6B_{18}$ composition. As is apparent from Table 1, the pulse-resistance deterioration percentage is drastically decreased due to the addition of Mo. The $\mu_2$ (after pulse deterioration) in Table 1 and in the descriptions hereinbelow is the permeability which is measured, after application of a magnetic field pulse of 4 Oe, under the condition of 100 kHz and 2 mOe (0.002 Oe).

In order to investigate whether or not the decrease in the pulse-resistance deterioration percentage due to Mo is attributable to a decrease in the magnetomechanical resonance, the present inventors measured the magnetic properties of the amorphous alloys shown in Table 2.

TABLE 2

| Composition | Magnetic Properties $B_2$ (kG) | Br (kG) | $B_{10}$ (kG) | Hc (Oe) | $\mu_2$ (after demagnetization) | $\mu_2$ (after pulse deterioration) | Pulse deterioration percentage (%) |
|---|---|---|---|---|---|---|---|
| $Fe_{76}Si_6B_{18}$ | 7.9 | 0.9 | 11.8 | 0.13 | 5000 | 4000 | 20 |
| $Fe_{73}Mo_3Si_6B_{18}$ | 9.7 | 0.8 | 10.9 | 0.1 | 7130 | 5700 | 20 |
| $Fe_{70}Mo_6Si_6B_{18}$ | 9.1 | 1.8 | 9.8 | 0.13 | 6130 | 5700 | 7 |

The magnetorstriction amount was not essentially changed by the addition of Mo.

In addition, the squareness ratio of the alloys according to the present invention was measured. This was less than 50%, and usually 20% or less.

It is therefore not believed that Mo is effective for enhancing the squareness ratio of the alloys according to the present invention.

Furthermore, it was discovered that Co, Ti, and W caused change in the magnetostriction amount.

Neither the squareness ratio nor the magnetostriction are attributable to the low pulse-resistance deterioration percentage.

Trial investigations from viewpoints other than those discovered above could not clarify which one of the physical properties is attirubutable to the low pulse-resistance deterioration percentage.

Components and Magnetic Properties of Fourth Composition

The meaning of the limitations is now explained.

The first, second, and third components are in an amount falling on or within the curve 3 shown in FIG. 3, because, in amounts outside the curve 3, the pulse-deterioration resistance is impaired and $\mu_2=4000$ is occasionally not attained. In other words, when the first, second and third components are outside the curve 3, the magnetic properties, such as a high magnetic flux density and low core loss required for the soft magnetic material, can be attained, since the conventional amorphous soft magnetic material having the Fe amount of around 80% do have such properties, but the pulse-resistance is seriously impaired. The amount of first, second and third components, which is indicated by the overlapping curves X and Y, is not included in the fourth composition, since the permeability ($\mu_2$) is generally low, e.g., approximately 3000.

The permeability ($\mu_2$) the residual flux density (Br), and the magnetic flux density ($B_2$) are determined in the third composition so as to provide the core of a noise filter which can effectively eliminate a high-voltage pulse, as specifically described hereinafter.

When the permeability ($\mu_2$) is less than approximately 4,000, the inductance of the core of a noise filter becomes too low to attain a high attenuation of noise or a low noise output voltage.

The lower the residual flux density (Br), the more advantageous are the characteristics of the core of a noise filter obtained. When the residual flux density (Br) exceeds 3 kG (Br>3 kG), the constant characteristic of permeability disadvantageously tends to be lost, with the result that, an efficient pulse-voltage elimination, which is attained at the constant permeability, is restricted.

When the magnetic flux density ($B_2$) is less than 5 kG, the permissible input voltage of noise disadvantageously becomes low. On the other hand, when the magnetic flux density ($B_2$) is more than 11 kG, the BH curve tends to have a non-linear portion, i.e., the permeability tends to become inconstant, and the permissible input voltage of noise becomes low. This means that steep increase of the curve shown in FIG. 2 occurs at a low input voltage.

Mo is more effective for the properties of amorphous alloy for the noise filter, than are the other additives, such as Nb, Cr, and the like, disclosed in the third composition, as is now described with reference to Table 3.

TABLE 3

| IVa | Va | $Fe_{76-x}M_xSi_6B_{18}$ VIa | VIIa | VIIIa | |
|---|---|---|---|---|---|
| Ti 0.5% | V 3% | Cr 3% | Mn 3% | Co 3% | Ni 3% |
| | 7,100 | 6,800 | 5,000 | 4,400 | 4,600 |
| | 4,700 | 4,200 | 4,000 | 3,700 | 3,200 |
| | 34 | 38 | 20 | 15 | 30 |
| | Nb 3% | Mo 3% | | | |
| | 5,900 | 7,100 | | | |
| | 4,500 | 5,700 | | | |
| | 24 | 20 | | | |
| | | W 1% | | | |
| | | 5,000 | | | |
| | | 4,000 | | | |
| | | 20 | | | |

In Table 3, Fe of the fundamental composition $Fe_{76}Si_6B_{18}$ is partly replaced with the components shown therein.

The upper, middle, and lower values of the replaced composition indicate $\mu_2$ (after demagnetization), $\mu_2$ (after the pulse deterioration), and the pulse-resistance deterioration percentage, respectively.

The $Fe_{76}Si_6B_{18}$ composition has the following properties:

$\mu_2$ (after demagnetization)=5000

$\mu_2$ (after pulse deterioration)=4000

Pulse-resistance deterioration percentage=20%

As is apparent from Table 2, Mo drastically enhances $\mu_2$ (after demagnetization and after pulse deterioration)

while maintaining the pulse deterioration percentage at 20%. W and Mo do not virtually change these properties. Ni impairs all of these properties. The other elements improve only either the $\mu_2$ (after demagnetization and after pulse deterioration) or the pulse-resistance deterioration percentage.

Incidentally, if Ti is included in an amount of 1% and W in an amount of 3%, the production of an amorphous alloy ribbon is impossible.

The first component is Fe and Mo or Fe plus Mo and at least one transition metal element selected from the 4s-transition elements (Sc-Zn), the 5s-transition elements (Y-Cd), the 6s-transition elements (La-Hg). The Mo and the at least one transition element are hereinafter referred to as the M. The M other than Mo is preferably Co, Ni, Cr, Cu, Mo, Nb, Ti, W, V, Zr, Ta, Y or a rare earth element. Ni and Co of the M components can be contained in the fourth composition in an amount up to approximately 20 atomic % based on Fe. The other M components (except for Mo) can be contained in the fourth composition in an amount up to approximately 5% based on Fe.

M is preferably Mn, Cr, Nb, Ni, or Co, more preferably Mn.

The second component is at least one element selected from the group consisting of Si and Al. The content of Al is preferably 10 atomic % or less based on the total content of Si and Al.

The third component is at least one element selected from the group consisting of B, C, and P. The content of Al is preferably 10% or less based on the total amount of Al and Si, the content of C is preferably 20 atomic % or less based on the total of B, C, and P, and the content of P is preferably 5% or less based on the total of B, C, and P.

When the first, second, and third components fall on or within the curve y, shown in FIG. 3, the $\mu_2$ (after demagnetization) of 5000 or more ($\mu_2 \geqq 5000$) is obtained. In addition when the first, second, and third components fall on or within the curve $y_2$ shown in FIG. 3, the $\mu_2$ (after demagnetization) of 6000 or more ($\mu_2 \geqq 6000$) can be obtained.

Structure and Heat Treatment of Third and Fourth Compositions

The structure of the amorphous alloy according to four compositions of the present invention is now described.

Usually, an amorphous alloy is distinguished from a conventional crystalline alloy in that in X-ray diffraction of the amorphous alloy there is no diffraction of the crystal lattices. The absence of diffraction of the crystal lattices is usually referred to as a halo pattern.

The strip of an amorphous magnetic alloy having the first and second compositions according to the present invention is distinguished from a conventinal amorphous alloy by the presence of precipitated fine crystals in the amorphous phases.

The diffraction specter of the thin strip of an amorphous magnetic alloy having the first and second compositions of the present invention shows a halo patter in the amorphous phases and a Debye-Scherrer ring of the precipitated fine crystals. Judging from the diameter and width of the Debye-Scherrer ring, the precipitated crystals are very fine and have an average grain diameter of from 10 to 1,000 Å (from 1 to 100 nm). The X-ray tube voltage and current are usually 30 KV and 100 mA, respectively, in the X-ray diffraction method.

The amorphous alloy according to the third and fourth compositions can have the claimed properties without the heat treatment. Alternatively, such amorphous alloy may be heat treated to attain the claimed properties or to enhance the properties of the core of a noise filter. The heat treatment is carried out at a temperature less than the crystallization temperature. During the heat treatment of the completely amorphous alloy, a small amount of the fine crystals may be precipitated depending upon the temperature and time of the heat treatment. The fine crystals precipitated in the amorphous alloy at a minor amount are detected by the following precedure. A thin strip of the amorphous alloy is subjected to ion-etching or electrolytic polishing to reduce its thickness to 50 nm or less. The thin strip is then observed by a transmission type electron microscope under the conditions of an accelerated voltage of 100–200 kV and magnification of 10,000 to 100,000. The presence and quantity of precipitated fine crystals can be determined by contrast.

The precipitation of fine crystals causes virtually no change in the saturation flux density (Bs) and causes the reduction in the residual flux density (Br). No matter if the fine crystals are not precipitated, during the heat treatment at a temperature below the crystallization temperature, the residual flux density (Br) is reduced without virtually causing the change in the saturation flux density (Bs). If the completely amorphous third and fourth compositions cannot attain the magnetic flux density ($B_2$) and the residual flux density (Br) according to the present invention, such amorphous alloy is heat treated, thereby attaining the magnetic flux density ($B_2$) and the residual flux density (Br). This attainment can be given even in a case of non-precipitation of the fine crystals. Desirably, the Br is as low as possible and may actually be zero ($Br \approx 0$), provided that $B_2$ and $\mu_2$ are as specified above, since an amorphous alloy actually having a zero Br can provide a core which has a small deterioration due to noise-pulse voltage, i.e., low variance in inductance, and which can stably eliminate a high-voltage pulse.

In the third composition, the preferable ratio of crystals to glass (glass/crystals) is usually 50% or less.

Where the fine crystals are precipitated in the amorphous alloy of the fourth composition, they are 3% by area or less, usually 0.5% by area or less.

A condition of the heat treatment for precipitating the fine crystals is explained with reference to Table 3.

The amorphous alloy subjected to the heat treatment is $Fe_{75}Mo_5Si_{12}B_8$, and under the conditions Nos. 3 through 7, the properties according to the present invention are attained.

TABLE 4

| Nos. | Condition | Fine crystals | $B_2$ | Br | $\mu_2$ (after demagnetization) | $\mu_2$ (after pulse deterioration) | Pulse-resistance deterioration percentage |
|---|---|---|---|---|---|---|---|
| 1 | 460° C. × 30 min | no | 9.3 | 5.3 | 7,300 | 1,970 | 73 |
| 2 | 460° C. × 60 min | no | 9.2 | 3.4 | 5,280 | 3,010 | 43 |
| 3 | 460° C. × 120 min | yes | " | 4.5 | 5,510 | 4,790 | 13 |
| 4 | 460° C. × 240 min | " | 7.6 | " | 4,970 | 4,570 | 8 |

TABLE 4-continued

| Nos. | Condition | Fine crystals | $B_2$ | Br | $\mu_2$ (after demagnetization) | $\mu_2$ (after pulse deterioration) | Pulse-resistance deterioration percentage |
|---|---|---|---|---|---|---|---|
| 5 | 470° C. × 90 min | " | 8.7 | 1.8 | 5,590 | 4,750 | 15 |
| 6 | 470° C. × 120 min | " | 8.4 | 1.7 | 5,010 | 4,560 | 9 |
| 7 | 470° C. × 180 min | " | 7.4 | 1.5 | 4,500 | 4,050 | 10 |

The $Fe_{73}Mo_5Si_9B_{13}$ amorphous alloy (the fourth composition) was subjected to various heat treatment to change the $\mu_2$ (after demagnetization). The influence of the $\mu_2$ (after demagnetization) upon the $\mu_2$ (after pulse deterioration) and the pulse-resistance deterioration percentage was investigated. The results are shown in FIG. 7.

Figure 7:
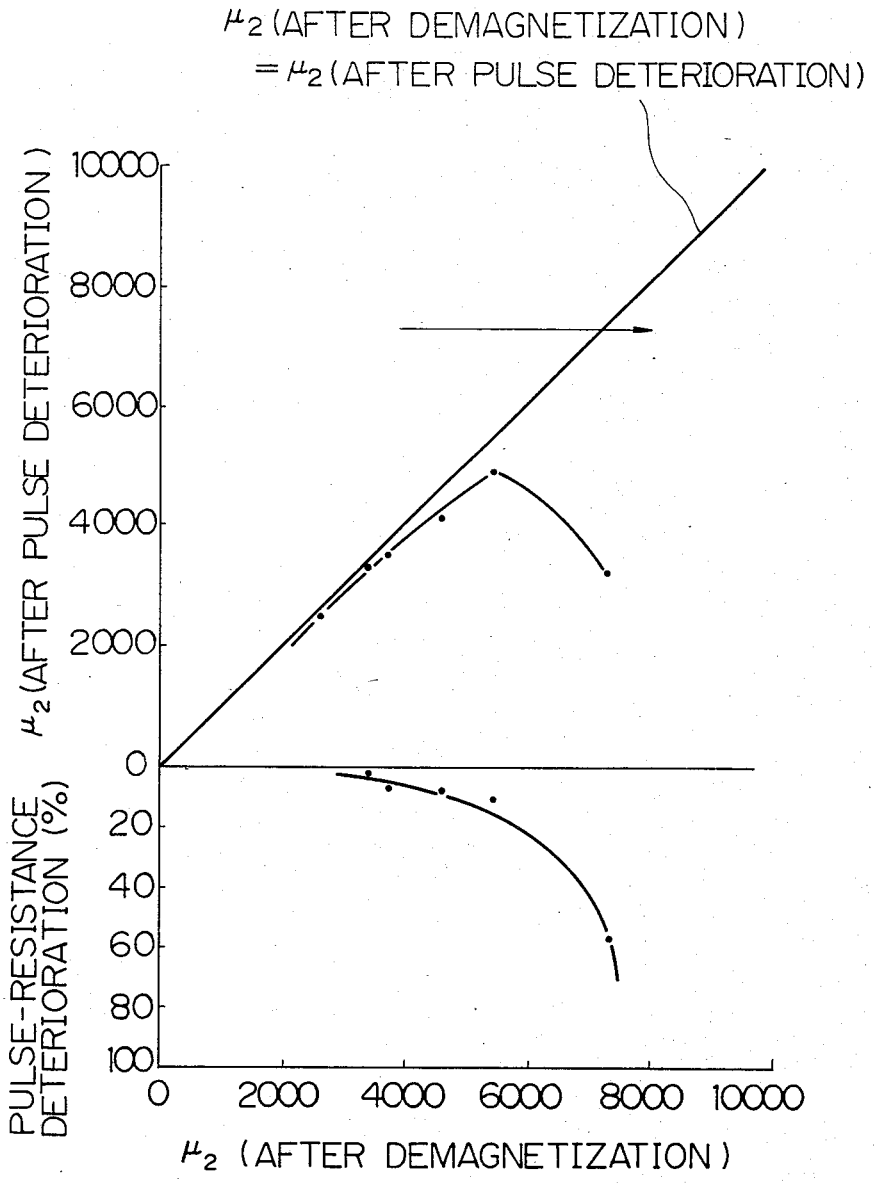
FIG. 7 is a graph indicating the relationship between the $\mu_2$ (after demagnetization) and the $\mu_2$ (after pulse deterioration) or the pulse-resistance deterioration percentage.

As is apparent from FIG. 7, the $\mu_2$ ( after pulse deterioration) lies slightly lower than the $\mu_2$ (after demagnetization) = $\mu_2$ (after pulse deterioration) line when the $\mu_2$ (after the demagnetization) is approximately 5000 or less. The $\mu_2$ (after pulse deterioration) lies far below this line, and the pulse-deterioration percentage is drastically decreased, when the $\mu_2$ (after demagnetization) is more than approximately 5500.

Such a tendency as shown in FIG. 7 is present in the amorphous alloy having the fourth composition but is mitigated due to Mo as compared with the amorphous alloy which is free of Mo.

Permeability

In the third and fourth composition according to the present invention, the permeability is one of the important factors. However, since the permeability of amorphous alloys is structure-sensitive, accurate measurement thereof is not always easy. In the experiments carried out by the present inventors, the permeability was measured as accurately as possible using a 4274 tester of HP Corporation. However, measurement of the permeability can involve a 5% error at the maximum.

Magnetic Anisotropy and Dimensions of Alloys According to 1st–4th Compositions In an embodiment of the present invention, magnetic anisotropy is induced in the strip in a predetermined direction parallel to the sheet surface. Due to such magnetic anisotropy, the suppression of a high-voltage noise pulse is enhanced, the permeability is increased, and various magnetic properties can be easily adjusted. The magnetic anisotropy is preferably a one-axis magnetic anisotropy and is induced along the longitudinal axis of the strip or along a slanted angle with respect to the longitudinal axis of the strip. Such magnetic anisotropy can be induced by the formation of precipitated fine crystals. That is, when a virtually completely vitrified thin strip of an amorphous alloy is heat-treated so as to form precipitated fine crystals, one-axis magnetic anisotropy is induced along the longitudinal axis of the strip during the heat treatment even if a magnetic field is not imparted to the strip at that time. When a magnetic field is imparted to a virtually completely vitrified thin strip which is being heat-treated or which has not yet been heat-treated, not only is magnetic anisotropy induced but also the direction of magnetic anisotropy can be adjusted.

The magnetic anisotropy may be in the axial direction of the coiled thin strip of an amorphous magnetic alloy, i.e., along the central axis of the coil. Magnetic anisotropy can be induced in the axial direction of the coiled thin strip by imparting a magnetic field to the coiled thin strip by placing the coiled thin strip between a pair of magnets. Magnetic anisotropy may be induced in a direction which is slanted with respect to the axial direction of a coiled thin strip of an amorphous magnetic alloy. The magnetic anisotropy can be easily verified by measuring the torque curve in a conventional manner.

In an embodiment of the present invention, the thin strip of an amorphous alloy has a thickness of from approximately 10 μm to 100 μm, preferably from 10 μm to 50 μm, and a width of from 0.1 cm to 50 cm.

Method for Producing a Noise Filter Core

In the present invention, the core is a wound core which may be manufactured by winding a thin strip of an amorphous alloy around a coil frame or form which may have not only a cylindrical or rectangular shape but also any desirable shape. The coil frame or form may be made of ceramic, glass, resin, or metal. One end of the coiled thin strip may be fixed to another part of the strip by any appropriate means, such as bonding, welding, taping, or caulking, and insulating material may be sandwiched between the opposed surface parts of the coiled thin strip. The coil frame or form may be used as a member for preventing distortion or deformatin of the coiled thin strip. Alternatively, resinous material may be molded around the coiled thin strip.

A method for producing a wound core is disclosed, for example, in Japanese Unexamined Patent Publication No. 57-24518, especially FIGS. 2 and 3.

In an embodiment of the present invention, the core comprises core members, each of which consists of a thin strip of an amorphous magnetic alloy. The core members do not have a cylindrical shape; rather, they have a predetermined shape, such as a U, C, I, L, or E shape or the like, formed by cutting a coiled thin strip of an amorphous magnetic alloy. The above-mentioned shapes of the core members may be optionally combined so as to form the amorphous magnetic alloy core of the present invention. Such a combination, which is known in the manufacture of transformers, can be applied in the manufacture of choke coils. Possible combinations of the core members are a combination of several I, U, C, or E-shaped core members and a combination of an E-shaped core member and several I-shaped core members.

Before the coiled thin strip of an amorphous magnetic alloy is cut into a core member having a predetermined shape, or before the coiled thin strip of an amorphous magnetic alloy is provided with at least one cut air gap, the coiled thin strip is bonded in such a manner that at least the portion to be cut and the neighboring portions are bonded to each other. Usually, the entire coiled thin strip of an amorphous magnetic alloy is dipped in or molded with a resinous material or the like so that the interior parts thereof are impregnated with the resinous material or the like from an exposed section of the coiled thin strip. Alternatively, the coiled thin strip may be caulked so as to make it more firm before it is cut.

In the present invention, the core may comprise at least one cut air gap in the magnetic path. Usually, this gap is from 0.001 to 0.05 times the length of the magnetic path. It can be formed by slitting the coiled thin strip of an amorphous magnetic alloy. Alternatively, the gap or gaps may be formed between the combined core members. That is, when the core members which are manufactured by cutting the coiled thin strip are combined, one or more ends of each of the core members are positioned so as to confront one another, with at least one cut air gap being left therebetween. Usually, the at least one cut air gap is filled with a spacer made of, for example, polyethylene terephthalate. Not only one cut air gap but also a pair of cut air gaps may be formed.

A heat treatment for precipitating fine crystals may be carried out in the ambient air, an inert gas, or a non-oxidizing atmosphere, and if a magnetic field is desired in the thin strip or the coiled thin strip of an amorphous magnetic alloy, the magnetic field can have an intensity of, for example. 100 Oe. The thin strip of an amorphous magnetic alloy may be subjected to tension during the heat treatment for precipitating fine crystals. Stress relief-annealing of the coiled thin strip of an amorphous magnetic alloy may also be carried out. The above-mentioned heat treatment may be carried out with regard to a cut core but may not be carried out with regard to a wound core.

In order to complete the core of the noise filter, such processes as winding, resin-molding, curing, etc. must be carried out. Since these processes are known in the manufacture of a choke coil having a ferrite- or silicon-steel core, they are not described herein.

The core which is made of the amorphous magnetic alloy having the first and second compositions according to the present invention should have the magnetic properties which S. Takayama and two others discovered to be appropriate for the core of a noise filter. These properties are as follows:

Initial permeability ($\mu i$): from 1,000 to 5,000

Residual flux density (Br): from 1 kG to 3 kG

Magnetic flux density at a magnetic field intensity of 2 Oe ($B_2$) from 6 kG to 9 kG The present inventors further investigated the magnetic properties and discovered that the residual flux density (Br) may be from 0 to 4 kG.

The noise filter circuit, in which the core according to the present invention is comprised, may be the same as the one disclosed, for example, in Japanese Unexamined Patent Publication No. 57-24518, especially FIGS. 6 and 7.

The present invention is hereinafter described with reference to the following examples.

EXAMPLE 1

One 8-mm wide and 30-$\mu$m thick thin strip of an amorphous magnetic alloy was formed by means of a known liquid rapid-cooling method. The amorphous magnetic alloy had a composition of $Fe_{75}Mn_{1-}(Si_{0.6}B_{0.39}C_{0.01})_{24}$, i.e., z=24 atomic %, t=0.6, and the ratio l/q=0.03. The strip was virtually completely vitrified and was cut into five pieces. One of the five pieces was not heat-treated, and the other four pieces were heat-treated under the conditions given in Table 5.

TABLE 5

| Samples | Heat Treatment | X-Ray Diffraction |
|---|---|---|
| 1-1 | — | Halo pattern only |
| 1-2 | 360° C., 60 min | Halo pattern only |
| 1-3 (Invention) | 420° C., 30 min | Halo pattern + diffraction peak |
| 1-4 (Invention) | 440° C., 30 min | Halo pattern + diffraction peak |
| 1-5 | 550° C., 10 min | Diffraction peak only |

The five samples were subjected to X-ray diffraction under the conditions given in Table 5. As is apparent from Table 5, the virtually completely vitrified amorphous magnetic alloy was continuously converted to a completely crystalline alloy in accordance with an increase in the heat treatment temperature.

EXAMPLE 2

The same type of thin strip as in Example 1 was formed and then was cut into five pieces. Each piece 10 (FIG. 8) was coiled into a toroidal form having an inner diameter of 19 mm, an outer diameter of 31 mm, and a width of 8 mm. Four of the pieces were heat-treated as shown in Table 5, and the remaining piece was not heat-treated. Epoxy resinous material was molded around each coiled thin strip and then the strips were cured, thereby producing the core 1A shown in FIG. 8. The core 1A was provided with a pair of windings 2A and 2B which offset the magnetic fluxes when the alternating currents conducted through the windings were of identical magnitudes and phases.

In FIG. 9, an electric circuit in which the noise filter was tested is shown. The noise filter was manufactured by using the core 1A, the windings 2A and 2B, and the capacitors $C_1$, $C_2$, $C_3$, and $C_4$. The noise filter is referred to as a common mode noise filter. The capacitors $C_1$, $C_2$, $C_3$, and $C_4$ had a capacitance of 0.22 $\mu$F, 0.22 $\mu$F, 5,000 pF, and 5,000 pF, respectively.

PG and A in FIG. 9 denote a pulse generator and an attenuator, respectively. A pulse voltage of 1,000 V and 1 $\mu$sec was transmitted from the pulse generator PG via the attenuator A into the noise filter. The resistors $R_1$ and $R_2$, each having a resistance of 50 Ω, were connected to the capacitors $C_3$ and $C_4$ in parallel. The connecting point of the resistors $R_1$ and $R_2$ was grounded. An oscillograph (not shown) was connected to the end (OUT) of the resistor $R_1$ so as to measure the output voltage. The results are shown in Table 6.

TABLE 6

| Cores (Samples) | Output Voltage (V) |
|---|---|
| 1-1 | 300 |
| 1-2 | 100 |
| 1-3 (Invention) | 20 |
| 1-4 (Invention) | 40 |
| 1-5 | 600 |

The cores shown in Table 6 were maintained at 120° C. for 1,000 hours and then the output voltage was measured so as to test the durability thereof. The output voltage of the cores 1-3, 1-4, and 1-5 virtually did not change. However, the output voltage of the cores 1-1 and 1-2 increased from 10% to 20%.

The above-mentioned output voltage was measured by using the electric circuit shown in FIG. 10, in which circuit the ends of the capacitor C were connected to each other. The same results as those mentioned above were obtained.

EXAMPLE 3

The procedure of Example 1 was repeated except that thin strips of an amorphous magnetic alloy had the compositions shown in Table 7 and were heat-treated at 440° C. for 30 minutes under no magnetic field. In the X-ray specter of the heat-treated thin strips, both halo and peak patterns were detected. The output voltage was then measured by the procedure of Example 2.

TABLE 7

| Core No. | | Composition $Fe_x$ | $Mn_y$ | $(Si_t$ | $B_q$ | $C_l)$ | z | Output Voltage (V) |
|---|---|---|---|---|---|---|---|---|
| 3 | | 82 | 1 | 0.22 | 0.74 | 0.04 | 17 | 20 |
| 4 | | 68 | 1 | " | " | " | 31 | 40 |
| 5 | | 75 | 1 | " | " | " | 24 | 30 |
| 6 | | 82 | 1 | 0.45 | 0.52 | 0.03 | 17 | 30 |
| 7 | | 68 | 1 | 0.65 | 0.33 | 0.02 | 31 | 50 |
| 8 | | 75 | 1 | 0.6 | 0.39 | 0.01 | 24 | 20 |
| 9 | | 76 | 1 | 0.74 | 0.25 | " | 23 | 40 |
| 10 | | 73 | 1 | 0.75 | 0.23 | 0.02 | 26 | 40 |
| 11 | Control | 75 | 1 | 0.92 | 0.07 | 0.01 | 24 | — |
| 12 | Control | 64 | 1 | 0.50 | 0.47 | 0.03 | 34 | 150 |
| 13 | Control | 84 | 1 | 0.30 | 0.67 | " | 15 | 140 |
| 14 | Control | 82 | 1 | 0.10 | 0.82 | 0.08 | 17 | 30 |

When the output voltage was measured after the cores were exposed to a temperature of 120° C. for 1,000 hours, only core No. 14 exhibited a great increase in the output voltage. In addition, marked stains were formed on core No. 14 due to poor corrosion resistance.

The values of t and z of core Nos. 1–14 are plotted in FIG. 4.

EXAMPLE 4

Thin strips of an amorphous magnetic alloy having the compositions shown in Table 8 were heat-treated at various temperatures for a fixed period of 30 minutes. Cores were produced from these thin strips. The same type of measurement as in Example 1 was carried out. In Table 8, the temperature margin, in which the output voltage was 40 V or less, is shown.

TABLE 8

| Core No. | Composition $Fe_x$ | $Mn_y$ | $(Si_t$ | $B_q$ | $C_l)$ | z | Temperature Margin (°C.) |
|---|---|---|---|---|---|---|---|
| 16 | 76 | — | 0.6 | 0.39 | 0.01 | 24 | 10 |
| 17 | 75.8 | 0.2 | " | " | " | " | 25 |
| 8 | 75 | 1 | " | " | " | " | 35 |
| 18 | 74 | 2 | " | " | " | " | 35 |
| 19 | 71 | 5 | " | " | " | " | 30 |

TABLE 8-continued

| Core No. | Composition $Fe_x$ | $Mn_y$ | $(Si_t$ | $B_q$ | $C_l)$ | z | Temperature Margin (°C.) |
|---|---|---|---|---|---|---|---|
| 20 | 61 | 15 | " | " | " | " | — |

The output voltage of core No. 20 was more than 40 V.

When the output voltage was measured after the cores were exposed to a temperature of 120° C. for 1,000 hours, only core No. 16, which was free of manganese, exhibited a great increase in the output voltage.

EXAMPLE 5

The same procedure as in Example 1 was repeated using thin strips of an amorphous magnetic alloy having the compositions shown in Table 9. An exposure test was not carried out.

TABLE 9

| Core No. | Composition $Fe_x$ | $Mn_y$ | $(Si_t$ | $B_q$ | $C_l)$ | z | l/q | Output Voltage (V) |
|---|---|---|---|---|---|---|---|---|
| 22 | 68 | 1 | 0.65 | 0.35 | — | 31 | 0 | 80 |
| 23 | 68 | 1 | " | 0.33 | 0.02 | " | 0.06 | 50 |
| 24 | 68 | 1 | 0.58 | 0.32 | 0.10 | " | 0.31 | 50 |

As is apparent from Table 9, when the ratio l/q is zero the output voltage is high.

EXAMPLE 6

The same procedure as in Example 1 was repeated using thin strips of an amorphous magnetic alloy having the compositions shown in Table 10.

TABLE 10

| Core No. | Composition $Fe_x$ | $Mn_y$ | $(Si_t$ | $B_q$ | $C_l$ | $P_s)$ | z | Output Voltage (V) | Secular Change |
|---|---|---|---|---|---|---|---|---|---|
| 8 | 75 | 1 | 0.6 | 0.39 | 0.01 | — | 24 | 20 | ○ |
| 26 | 75 | 1 | " | 0.38 | " | 0.01 | " | 20 | ◎ |
| 27 | 75 | 1 | " | 0.36 | " | 0.03 | " | 30 | ◎ |
| 28 (Control) | 75 | 1 | " | 0.313 | 0.004 | 0.083 | " | 150 | ◎ |

As is apparent from Table 10, phosphorus can decrease the output voltage. The symbols ◎ and ○ indicate a slight secular change and no secular change, respectively, in the output voltage when the cores were exposed to a temperature of 120° C. for 1,000 hours.

EXAMPLE 7

Samples having the composition of $Fe_{75}Mn_1(Si_{0.6}B_{0.39}C_{0.01})_{24}$ were subjected to heat treatment under various conditions, thereby changing the magnetic properties as shown in Table 11. The output voltage of the cores which were made of the heat-treated samples was measured by the procedure of Example 2.

TABLE 11

| X-Ray Diffraction | $\mu_i$ | $B_r$ (kG) | $B_2$ (kG) | Output Voltage (V) |
|---|---|---|---|---|
| Halo Pattern Only | 900 | 6.0 | 7.0 | approximately 250 |
| Halo Pattern + Diffraction Peak | 4800 | 3.9 | 9.0 | 40 |
| Halo Pattern + Diffraction Peak | 4000 | 2.1 | 8.0 | 20 |
| Halo Pattern + Diffraction Peak | 1550 | 1.0 | 6.0 | 40 |

TABLE 11-continued

| X-Ray Diffraction | $\mu_i$ | $B_r$ (kG) | $B_2$ (kG) | Output Voltage (V) |
|---|---|---|---|---|
| Diffraction Peak Only | 200 | 0.03 | 0.5 | approximately 500 |

EXAMPLE 8

Amorphous magnetic alloy thin strips 18 μm thick and 8 mm wide were produced by a known single-roll method, were wound as cores, and were heat-treated. The properties of the heat-treated cores were measured. These properties and the compositions of the amorphous magnetic alloy thin strips are shown in Table 12.

TABLE 12

| No. | Composition | $B_2$ (kG) | $B_r$ (kG) | $\mu_2$ (Demagnetization) | $\mu_2$ (Pulse) | Pulse-Resistance Deterioration Percentage |
|---|---|---|---|---|---|---|
| 1 | $Fe_{73}Si_{18}B_9$ | 8.1 | 4.5 | 3.083 | 2.072 | 32.9 |
| 2 | $Fe_{73}Si_{15}B_{12}$ | 8.5 | 4.5 | 4.484 | 3.796 | 15.3 |
| 3* | $Fe_{73}Si_{12}B_{15}$ | 7.8 | 1.0 | 4.903 | 4.636 | 5.4 |
| 4* | $Fe_{73}Si_9B_{18}$ | 7.0 | 1.5 | 3.888 | 3.605 | 7.3 |
| 5 | $Fe_{73}Si_6B_{21}$ | 8.2 | 2.2 | 3.985 | 3.111 | 21.9 |
| 6 | $Fe_{76}Si_{15}B_9$ | 8.2 | 4.8 | 4.372 | 2.150 | 50.8 |
| 7 | $Fe_{76}Si_{12}B_{12}$ | 8.1 | 2.2 | 5.198 | 4.304 | 17.2 |
| 8* | $Fe_{76}Si_9B_{15}$ | 6.7 | 1.2 | 4.793 | 4.351 | 9.2 |
| 9* | $Fe_{76}Si_6B_{18}$ | 7.9 | 0.9 | 4.679 | 4.687 | 4.1 |
| 10 | $Fe_{76}Si_3B_{21}$ | 8.4 | 1.0 | 5.252 | 3.724 | 29.1 |
| 11 | $Fe_{78}Si_{15}B_7$ | 8.6 | 4.3 | 3.315 | 2.215 | 33.2 |
| 12 | $Fe_{78}Si_{12}B_{10}$ | 8.6 | 3.5 | 3.902 | 2.769 | 29.0 |
| 13 | $Fe_{78}Si_9B_{13}$ | 6.6 | 0.9 | 4.724 | 3.687 | 22.0 |
| 14 | $Fe_{78}Si_6B_{16}$ | 7.9 | 0.8 | 5.034 | 4.093 | 18.7 |
| 15 | $Fe_{78}Si_3B_{19}$ | 7.6 | 1.8 | 5.116 | 3.556 | 30.5 |
| 16 | $Fe_{80}Si_9B_{11}$ | 6.7 | 2.2 | 3.442 | 2.224 | 35.4 |
| 17 | $Fe_{80}Si_6B_{14}$ | 7.6 | 1.1 | 4.741 | 3.267 | 31.1 |
| 18 | $Fe_{80}Si_3B_{17}$ | 7.1 | 0.7 | 4.724 | 2.967 | 37.2 |
| 19 | $Fe_{82}Si_6B_{12}$ | 8.5 | 7.3 | 2.364 | 826 | 65.1 |
| 20 | $Fe_{82}Si_3B_{15}$ | 9.1 | 7.6 | 2.117 | 950 | 55.1 |
| 21 | $Fe_{82}Si_{0.5}B_{17.5}$ | 8.2 | 7.0 | 3.033 | 1.099 | 63.8 |
| 22* | $Fe_{72}Mn_1Si_9B_{19}$ | 7.6 | 1.0 | 4.860 | 4.670 | 3.9 |
| 23* | $Fe_{72}Cr_1Si_9B_{18}$ | 7.3 | 1.3 | 4.370 | 4.170 | 4.6 |
| 24* | $Fe_{72}Mo_1Si_9B_{18}$ | 7.3 | 1.8 | 4.510 | 4.150 | 7.9 |
| 25* | $Fe_{72}Nb_1Si_9B_{18}$ | 7.5 | 1.3 | 4.560 | 4.200 | 4.1 |
| 26* | $Fe_{70}Ni_3Si_9B_{18}$ | 7.7 | 2.7 | 3.160 | 2.860 | 9.5 |
| 27* | $Fe_{70}Co_3Si_9B_{18}$ | 7.1 | 2.5 | 2.970 | 2.700 | 9.1 |
| 28* | $Fe_{73}Si_9B_{14.2}C_{3.5}P_{0.3}$ | 7.1 | 1.2 | 4.850 | 4.680 | 3.5 |
| 29* | $Fe_{73}Si_9B_{14.2}C_{3.5}P_{0.3}Al_{0.1}$ | 6.7 | 0.9 | 4.750 | 4.390 | 7.6 |

In Table 12, the compositions indicated by * are those of the present invention, and the compositions not indicated by * are comparative examples. As is apparent from Table 12, the amounts of the first component (Fe alone or a combination of Fe and M), the second component (Si alone or a combination of Si and Al), and the third component (B alone or a combination of B, C, and P) are critical for obtaining improved resistance to pulse.

EXAMPLE 9

Amorphous alloy thin strips 18 μm in thickness and 8 mm in width were produced by a known single roll method, wound in the form of a wound core, and heat treated. The properties of the cores and the composition of the amorphous alloy are shown in Table 13.

TABLE 13

| | Composition Fe | Mo | Si | B | $B_2$ (kG) | Br (kG) | $\mu_2$ (after demagnetization) | $\mu_2$ (after pulse deterioration) | Pulse-resistance deterioration percentage (%) |
|---|---|---|---|---|---|---|---|---|---|
| 1 | 73 | 3 | 12 | 12 | 9.8 | 1.3 | 5,610 | 4,600 | 18 |
| 2 | 75 | " | 6 | 14 | 10.1 | 1.1 | 7,400 | 6,360 | 14 |
| 3 | " | " | 9 | 13 | " | 0.8 | 6,800 | 6,320 | 7 |
| 4 | " | " | 12 | 10 | 10.0 | 1.2 | 5,830 | 4,780 | 18 |
| 5 | 77 | " | 6 | 14 | 10.3 | 1.5 | 5,410 | 4,330 | 20 |
| 6 | " | " | 10 | 10 | 10.2 | 1.2 | 5,330 | 4,370 | 18 |
| 7 | 71 | 7 | " | 12 | 5.9 | 1.1 | 5,380 | 4,570 | 15 |
| 8 | 73 | " | 9 | 11 | 5.8 | 0.8 | 6,150 | 5,660 | 8 |
| 9 | " | " | 12 | 8 | 6.6 | 1.4 | 5,850 | 5,030 | 14 |
| 10 | 75 | " | 6 | 12 | 5.1 | 1.8 | 4,730 | 4,260 | 10 |
| 11 | " | " | 9 | 9 | 6.3 | 1.0 | 7,140 | 6,350 | 11 |

As is apparent from Table 13, an improved pulse-resistance and $\mu_2$ (after demagnetization) of more than 6000 can be provided by the first component (combination of Fe with 3% or more of Mo), second component (Si), and third component (B).

We claim:

1. A core of a noise filter comprising a coiled thin strip of an amorphous magnetic alloy which partially contains precipitated crystals and essentially has the following composition:

$$M_xMn_y(Si_lB_qC_l)_z,$$

wherein M is Fe or Fe together with at least one transition metal element other than Fe, $x+y+z=100$ atomic %, y is from 0.1 atomic % to 10 atomic %, z is from 16 atomic % to 32 atomic %, $t+q+l=1$, t is from 0.20 to 0.80, l is from 0.0001 to 0.05, the ratio l/q is from 0.01 to 0.4, and $20t+6 \leqq z \leqq -50t+67$.

2. A core according to claim 1, wherein said y is from 0.1 to 5 atomic %.

3. A core according to claim 1, wherein said amorphous magnetic alloy additionally contains up to 10 atomic % of at least one of the metalloid elements selected from the group consisting of Al, Be, Ge, Sb, and In based on the total number of metalloid elements.

4. A core according to claim 1, wherein magnetic anisotropy is induced in said thin strip in a predetermined direction parallel to the sheet surface.

5. A core according to claim 1, wherein the magnetic anisotropy is a one-axis magnetic anisotropy induced along the longitudinal axis of said thin strip or along the slanted angle with respect to said longitudinal axis.

6. A core of a noise filter according to claim 1, wherein said amorphous magnetic alloy has an initial permeability ($\mu i$) of from 1,000 to 5,000, a residual flux density (Br) of from 1 kG to 4 kG, and a magnetic flux density at a magnetic field intensity of 2 Oe ($B_2$) of from 6 kG to 9 kG.

7. A core of a noise filter according to the present invention comprises a coiled thin strip of an amorphous magnetic alloy which partially contains precipitated crystals and which essentially has the following composition:

$$M_xMn_y(Si_tB_qC_lP_s)_z,$$

wherein M is Fe or Fe together with at least one transition metal element, y is from 0.1 atomic % to 10 atomic %, z is from 16 atomic % to 32 atomic %, $t+q+l+s=1$, t is from 0.20 to 0.80, s is from 0.0001 to 0.05, the ratio l/q is from 0.01 to 0.4, and $20t+6 \leqq z \leqq -50t+67$.

8. A core according to claim 7, wherein said y is from 0.1 to 5 atomic %.

9. A core according to claim 7, wherein said s is from 0.0001 to 0.02.

10. A core according to claim 7, wherein said amorphous magnetic alloy additionally contains up to 10 atomic % of at least one of the metalloid elements selected from the group consisting of Al, Be, Ge, Sb, and In based on the total number of metalloid elements.

11. A core according to claim 7, wherein magnetic anisotropy is induced in said thin strip in a predetermined direction parallel to the sheet surface.

12. A core according to claim 7, wherein the magnetic anisotropy is a one-axis magnetic anisotropy induced along the longitudinal axis of said thin strip or along a slanted angle with respect to said longitudinal axis.

13. A core according to claim 7, wherein said amorphous magnetic alloy has an initial permeability ($\mu i$) of from 1,000 to 5,000, a residual flux density (Br) of from 1 kG to 4 kG, and a magnetic flux density at a magnetic field intensity of 2 Oe ($B_2$) of from 6 kG to 9 kG.

14. A noise filter comprising a core and a pair of windings for generating magnetic fluxes, the sum of said magnetic fluxed being zero when the currents conducted through the windings have identical magnitudes and phases, said core comprising a coiled thin strip of an amorphous magnetic alloy which partially contains precipitated crystals and essentially has the following composition:

$$M_xMn_y(Si_tB_qC_l)_z,$$

wherein M is Fe or Fe together with at least one transition metal element other than Fe, $x+y+z=100$ atomic %, y is from 0.1 atomic % to 10 atomic %, z is from 16 atomic % to 32 atomic %, $t+q+l=1$, t is from 0.20 to 0.80, l is from 0.0001 to 0.05, the ratio l/q is from 0.01 to 0.4, and $20t+6 \leqq z \leqq -50t+67$.

15. A noise filter comprising a core and a pair of windings for generating magnetic fluxes, the sum of said magnetic fluxes being zero when the currents conducted through the windings have identical magnitudes and phases, said core comprising a coiled thin strip of an amorphous magnetic alloy which partially contains precipitated crystals and which essentially has the following composition:

$$M_xMn_y(Si_tB_qC_lP_s)_z,$$

wherein M is Fe or Fe together with at least one transition metal element, y is from 0.1 atomic % to 10 atomic %, z is from 16 atomic % to 32 atomic %, $t+q+l+s=1$, t is from 0.20 to 0.80, s is from 0.0001 to 0.05, the ratio l/q is from 0.01 to 0.4, and $20t+6 \leqq z \leqq -50t+67$.

16. A core of a noise filter comprising a coiled thin strip of an amorphous magnetic alloy, said amorphous magnetic alloy partially containing precipitated fine crystals and essentially consisting of a first component which is Fe or Fe together with at least one transition metal element, a second component which is at least one selected from the group consisting of Si and Al, and a third component which is at least one selected from the group consisting of B, C, and P, the first, second, and third components being contained in an amount falling on or within curve X shown in FIG. 3, and exhibiting a permeability ($\mu_2$) of from approximately 2,000 to approximately 5,000, i.e., a permeability measured at 100 kHz and a magnetic field of 2 mOe, 3 kG or less of a residual flux density (Br) determined in a BH curve at a frequency of 2 kHz and a maximum applied magnetic field of 2 Oe, and from 6 kG to 9 kG of a magnetic flux density ($B_2$), i.e., a magnetic flux density at 2 Oe.

17. A core according to claim 16, wherein said at least one transition metal element is selected from the group consisting of Co, Ni, Cr, Cu, Mo, Nb, Mn, Ti, W, V, Zr, Ta, Y, and a rare earth element.

18. A core according to claim 17, wherein said at least one transition metal element is selected from the group consisting of Mn, Cr, Mo, Nb, Ni, and Co.

19. A core according to claim 18, wherein said at least one transition metal element is selected from the group consisting of Ni and Co and is in an amount replacing up to 20 atomic % of Fe.

20. A core according to claim 18, wherein said at least one transition metal element is selected from the group consisting of Mn, Mo, Nb, and Cr and is in an amount replacing up to 5 atomic % of Fe.

21. A core according to claim 20, wherein said at least one transition metal element is Mn.

22. A core according to claim 17, said core having from 0 to −10% of a pulse-resistance deterioration percentage which is defined by the equation:

$$\frac{\mu e\left(\begin{array}{l}\text{after application}\\ \text{of a magnetic}\\ \text{field of 4 Oe}\end{array}\right) - \mu e\ (\text{demagnetization})}{\mu e\ (\text{demagnetization})} \times 100(\%)$$

wherein $\mu e$ is the permeability at 100 kHz and 2 mOe (0.002 Oe).

23. A core of noise filter comprising a coiled thin strip of an amorphous magnetic alloy, characterized in that said alloy essentially consists of a first component which is Fe and Mo, a second component which is at least one selected from the group consisting of Si and Al, and a third component which is at least one selected from the group consisting of B, C, and Al, the first, second, and third components being contained in an amount falling on or within curve Y and falling outside the curve X shown in FIG. 3, the Mo content is up to 7%, and exhibits a permeability ($\mu_2$) of approximately 4,000 or more, i.e., a permeability measured at 100 kHz and a magnetic field of 2 mOe, a 3 kG or less of a residual flux density (Br) determined on a BH curve at a frequency of 2 kHz and a maximum applied a magnetic field of 2 Oe, and from 5 kG to 11 kG of a magnetic flux density ($B_2$), i.e., a magnetic flux density at 2 Oe.

24. A core according to claim 23, wherein the Mo content is 3% or more.

* * * * *

UNITED STATES PATENT AND TRADEMARK OFFICE

CERTIFICATE OF CORRECTION

PATENT NO. : 4,637,843

DATED : January 20, 1987

INVENTOR(S) : SUGURU TAKAYAMA et al

It is certified that error appears in the above-identified patent and that said Letters Patent is hereby corrected as shown below:

Claim 7, lines 1 and 2, delete "according to the present invention".

Signed and Sealed this

Eighth Day of September, 1987

*Attest:*

DONALD J. QUIGG

*Attesting Officer*

*Commissioner of Patents and Trademarks*